United States Patent [19]

Paraskos et al.

[11] 4,157,291

[45] Jun. 5, 1979

[54] PROCESS FOR EXTENDING LIFE OF COAL LIQUEFACTION CATALYST

[75] Inventors: John A. Paraskos; Herman Taylor, Jr., both of Pittsburgh, Pa.

[73] Assignee: Gulf Research & Development Company, Pittsburgh, Pa.

[21] Appl. No.: 878,019

[22] Filed: Feb. 15, 1978

Related U.S. Application Data

[63] Continuation-in-part of Ser. No. 746,179, Nov. 30, 1976, abandoned.

[51] Int. Cl.[2] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 3,232,861 | 2/1966 | Gorin et al. | 208/10 |
| 3,275,546 | 9/1966 | Retallick | 208/108 |
| 3,514,394 | 5/1970 | Wilson, Jr. et al. | 208/10 |
| 3,549,512 | 12/1970 | Hodgson | 208/10 |
| 3,932,266 | 1/1976 | Sze et al. | 208/10 |

*Primary Examiner*—Delbert E. Gantz
*Assistant Examiner*—William G. Wright

[57] ABSTRACT

A catalytic process for liquefying coal wherein the life of the catalyst is extended by periodic screening to remove ash-containing particulate matter.

13 Claims, 2 Drawing Figures

PROCESS FOR EXTENDING LIFE OF COAL LIQUEFACTION CATALYST

Figure 1:
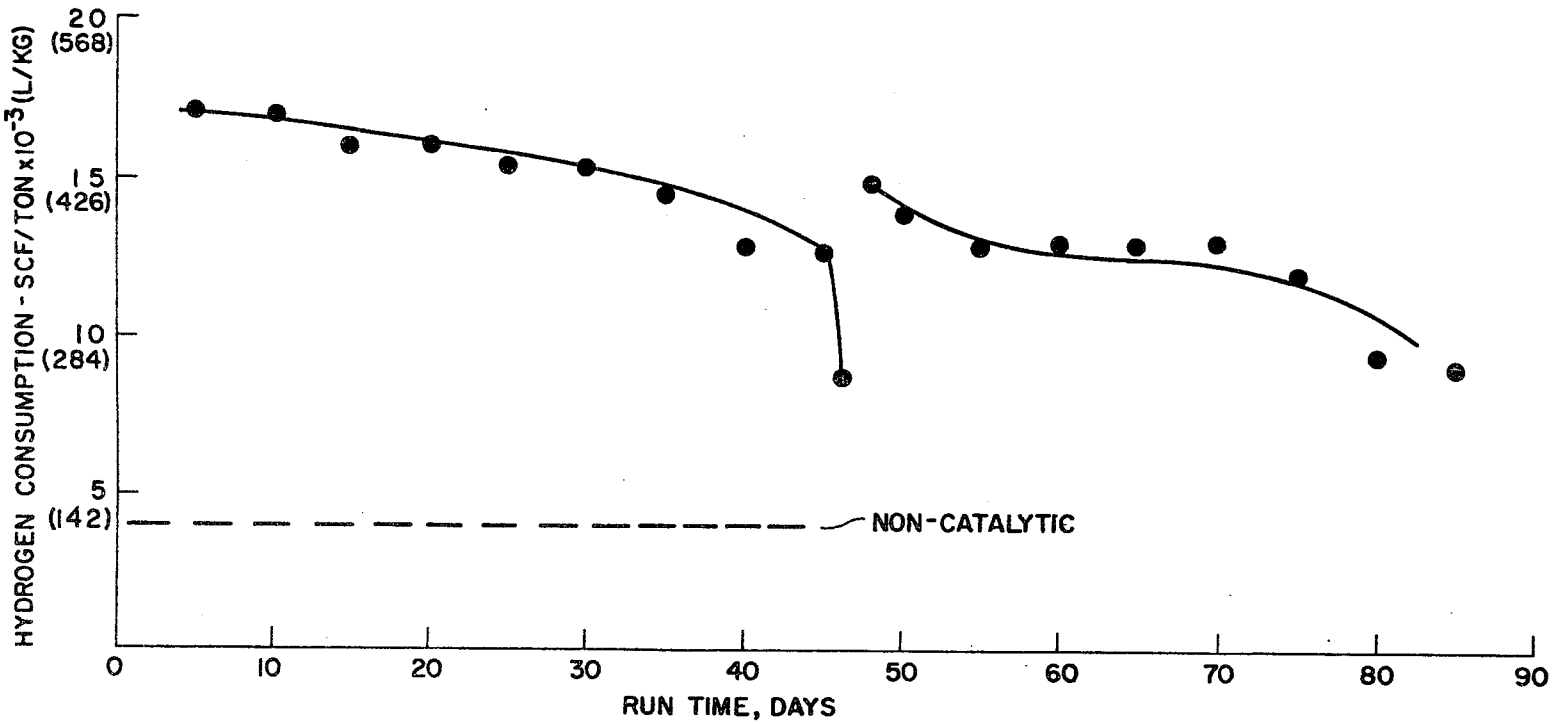

This application is a continuation-in-part of Ser. No. 746,179, filed Nov. 30, 1976, now abandoned.

This invention relates to a process for extending the life of a catalyst in a process for converting ash-containing raw coal to deashed coal liquids.

The coal liquefaction process of the present invention utilizes a preheater zone, an optional dissolver zone, and a catalyst zone in series. The preheater zone is an essentially non-backmixed tubular zone which is supplied with a slurry of pulverized feed coal and solvent wherein the temperature of each increment or plug of slurry increases during flow through the preheater to a maximum at the preheater outlet. The preheater effluent can be passed directly into a catalytic hydrogenation zone. However, it is preferred that it first be processed in a dissolver zone. Therefore, the following process description will include the dissolver zone.

When the dissolver zone is employed, the preheater effluent passes into the dissolver zone which is operated under conditions tending to approach backmixing in order to maintain as close to a uniform temperature throughout as possible, which temperature is higher than the maximum temperature in the preheater zone. The dissolver zone is followed by the catalytic hydrogenation zone. The catalytic hydrogenation zone is operated at a reduced severity as compared to the dissolver zone, including a temperature which is lower than the temperature in the dissolver zone and/or a liquid residence time which is lower than the liquid residence time in the dissolver zone. The catalyst zone employs a particulate hydrogenation catalyst comprising Group VI and Group VIII metals on a non cracking support. Suitable catalysts include cobalt-molybdenum and nickel-cobalt-molybdenum or alumina. The temperature in the dissolver zone is at least about 10° F., generally, or at least about 50° to 100° F., preferably, (about 5.5° C., generally, or at least about 27.8 or 55.5° C., preferably,) higher than the maximum preheater temperature. The temperature in the catalyst zone can be lower than the temperature in the dissolver zone. For example, the temperature in the catalyst zone can be about 20° F., or about 50° or 150° F., (about 13.9° C., or about 27.8° or 83.3° C.) lower than the dissolver temperature.

The preheater exit temperature is maintained within the range of about 710 to below about 800° F. (377 to below about 427° C.), generally, or 750° to 790° F. (399° to 421° C.), preferably. During the preheating step, the viscosity of each increment of feed slurry initially increases, then decreases and would finally tend to increase again. However, a significant final increase in viscosity is avoided by terminating the preheating step within the temperature range of 710° to below 800° F. (377° to below 427° C.). If the preheater temperature exceeds this range, a substantial increase in viscosity can occur caused by polymerization of the dissolved coal. Such polymerization should be avoided since its result is formation of a product comprising a relatively large quantity of low value solid deashed coal at the expense of more valuable liquid coal. These viscosity effects are described in U.S. Pat. No. 3,341,447 to Bull et al, which is hereby incorporated by reference.

The final increase in viscosity in the preheater is avoided by passing the essentially plug flow preheater effluent at a temperature from about 710° to below 800° F. (377° to below 427° C.) into an essentially backmixed dissolver zone maintained at a uniform temperature which is higher than the maximum preheater temperature. The dissolver temperature is in the range between about 750° and 900° F. (399° and 482° C.), generally, and between about 800° and 900° F. (427° and 482° C.), preferably. The temperature hiatus between the preheater and dissolver stages can be the temperature range in which the undesired coal polymerization would occur. At the elevated dissolver temperature of this invention, instead of the aforementioned coal polymerization and viscosity increase, there is a viscosity decrease due to a molecular weight reduction via hydrocracking reactions. We have found that in order for hydrocracking reactions to proceed effectively in the dissolver, a process hydrogen pressure of at least 3,100 or, preferably, at least 3,500 psi (217 or 245 Kg/cm$^2$) is required. A lower process hydrogen pressure, the elevated dissolver temperature of this invention in combination with the extended residence times indicated below was found to induce excessive coking and thereby encourage production of carbonaceous insolubles at the expense of coal liquids. Therefore, in the dissolver stage of this invention, the use of an elevated temperature within the range of about 750° to 900° F. (399° to 482° C.) is accompanied by a process hydrogen pressure above 3,100 psi, generally, and at least above 3,500 psi (217 and 245 Kg/cm$^2$), preferably. There is generally little advantage in employing a hydrogen pressure above 5,000 psi (350 Kg/cm$^2$). If carbon monoxide is employed with hydrogen, these pressures are the combined pressures of carbon monoxide and hydrogen.

The residence time in the preheater zone is between about 2 and 20 minutes, generally, and is between about 3 and 10 minutes, preferably. The residence time in the dissolver zone is longer than in the preheater zone in order to provide adequate time for thermal hydrocracking reactions to occur and is between about 5 and 60 minutes, generally, or between about 10 and 45 minutes, preferably. The use of an external preheater avoids a preheating function in the dissolver zone and thereby tends to reduce the residence time in the dissolver zone, thereby reducing the amount of coking occurring in the dissolver zone. Hydrocracking and coking are concurrent reactions in the dissolver zone. Hydrocracking is the more rapid of the two reactions and any unnecessary extension of dissolver residence time will relatively favor the slower coking reactions over the more rapid hydrocracking reactions.

The primary solvation reactions in the preheater zone occur between the solvent and the feed coal and are considered to be endothermic. In contrast, the hydrocracking reactions occurring in the dissolver zone are known to be exothermic. Therefore, the preheater requires heat input for the solvation reactions and to heat the mass of feed material in the preheater while the dissolver not only sustains its own heat requirements but can also produce excess heat which is available for transfer to the preheater. If desired, the temperature in the dissolver can be controlled by injection of either hot or cold hydrogen into the dissolver, or by means of a heating or cooling coil. By maintaining the indicated temperature differential between the preheater and dissolver zones the excess heat available at the dissolver zone is at a sufficiently elevated temperature level that it can advantageously supply at least a portion of the heat requirement of the preheater, providing a heat balanced system.

In the absence of a subsequent catalytic stage, the dissolver effluent would be reduced in pressure and passed to a distillation zone, preferably a vacuum distillation zone, to remove individual distillate fractions comprising product coal liquid, product deashed solid coal, recycle solvent and a bottoms fraction comprising ash and non-distillable hydrocarbonaceous residue. However, such a distillation step results in a considerable loss of carbonaceous material from the valuable product fractions in the form of solid deposits within the distillation column. The reason for this loss is that the dissolver effluent bottoms comprise mostly dissolved asphaltenes. The asphaltenes are not stabilized as they leave the dissolver and upon distillation some can revert to an insoluble, non-distillable material. However, such a reversion is avoided in accordance with this invention by passing the dissolver effluent at process hydrogen pressure through a catalytic hydrotreating stage.

Although the catalyst stage does not perform a coal dissolving function, it increases product yield by stabilizing asphaltenes as liquids that would otherwise separate as an insoluble solid such as coke and by partially saturating aromatics in the solvent boiling range to convert them to hydrogen donor materials for use as recycle solvent. The dissolver zone improves operation of the catalyst zone by exposing the feed stream to at least one condition which is more severe than prevails in the catalyst zone, and which induces hydrocracking, thereby tending to reduce the viscosity of the stream so that in the catalyst zone there is an improvement in the rate of mass transfer of hydrogen to catalyst sites in order to reduce coking at the catalyst. The more severe cracking conditions in the dissolver zone can include either or both of a longer residence time and a higher temperature than prevails in the catalyst zone. If required, the dissolver effluent can be reduced in temperature before entering the catalyst zone so that the catalyst zone is maintained at non-coking temperatures in the range of 700° to 825° F. (371° to 441° C.) and preferably in the range of 725° to 800° F. (385° to 427° C.) in order to inhibit catalyst coking and to extend catalyst life. If the catalyst zone were operated at the more severe conditions of the non-catalytic dissolver zone, the rate of mass transfer of hydrogen would be inadequate to control coke make because of the high hydrogenation-dehydrogenation reaction rates experienced in the presence of supported Group VI and Group VIII metal hydrogenation catalysts at temperatures above about 700° F. (371° C.). On the other hand, temperatures in the hydrocracking range in the dissolver zone induce much less coking because in the absence of a catalyst reaction rates are sufficiently low that the hydrogen mass transfer rate in the system is ordinarily adequate to reasonably inhibit coking at moderate residence times. While we have found that coking is controllable in the non-catalytic dissolver zone at a temperature in the 750° to 900° F. (399° to 482° C. ) range, provided that the hydrogen pressure is at least about 3,100 psi (217 Kg/cm$^2$), we have also found that coking is too excessive in a catalytic zone at these same temperatures and hydrogen pressures to achieve adequate catalyst aging characteristics.

The 3,100+psi (217+ Kg/cm$^2$) hydrogen pressure of this invention is critical in the catalyst zone as well as in the dissolver zone. The reason for this criticality is that, as stated above, supported Group VI and Group VIII metal catalysts induce high hydrogenation and dehydrogenation reaction rates. At elevated temperatures and at hydrogen pressures below 3,100 psi (217 Kg/cm$^2$), dehydrogenation reactions (coking) tend to become excessive. However, at hydrogen pressures of 3,100 psi (217 Kg/cm$^2$), or more, sufficient hydrogen is dissolved in the coal liquid in the vicinity of active catalyst sites to promote hydrogenation reactions in preference to dehydrogenation reactions. The 3,100+ psi (217+ Kg/cm$^2$) hydrogen pressure was found to represent a threshhold pressure level for inhibiting excessive dehydrogenation reactions. For example, at a hydrogen pressure of 3,000 psi (210 Kg/cm$^2$) in the catalyst stage, coking was found to be sufficiently severe to limit the catalyst life cycle to only about seven to ten days. In contrast, by increasing the hydrogen pressure to 4,000 psi (280 Kg/cm$^2$), the catalyst life cycle was extended to several months. This hydrogen pressure in the catalyst zone is accompanied by a hydrogen circulation rate of 1,000 to 10,000 SCF/B, generally, and 2,000 to 8,000 SCF/B, preferably (18 to 180 SCM/100L, generally, and 36 to 144 SCM/100L, preferably). The liquid space velocity in the catalyst zone can be 0.5 to 10, generally, or 2 to 6, preferably, weight units of oil per hour per weight unit of catalyst.

The encouragement of hydrogenation reactions in preference to dehydrogenation reactions in the catalyst zone further contributes to an increase in liquid product yield by providing a high yield of solvent boiling range hydrogen donor material for recycle. Since it is hydrogen donor aromatics that accomplish solvation of feed coal, a plentiful supply of such material for recycle encourages coal solvation reactions in the preheater and dissolver zones, thereby reducing the amount of coal insolubles.

Since the catalytic production of a high yield of partially saturated aromatics is important, a measure of the effectiveness of the catalyst zone is the amount of hydrogen which is consumed in that zone. In order for sufficient hydrogenation to occur in the catalyst zone, the catalyst activity should be sufficient so that at least about 4,000 standard cubic feet (112 cubic meters) of hydrogen per ton (1,016 Kg) of raw feed coal is chemically consumed, generally, or so that at least about 10,000 standard cubic feet (280 cubic meters) of hydrogen per ton (1,016 Kg) of raw feed coal is chemically consumed, preferably. At these levels of hydrogen consumption a substantial quantity of high quality hydrogen donor solvent will be produced for recycle, inducing a high yield of liquid product in the process. Such a high level of hydrogen consumption in the catalyst zone illustrates the limited capability of the non-catalystic dissolver stage for hydrogenation reactions. Furthermore, such a high level of hydrogen consumption in the catalyst zone indicates that coking deactivation of the catalyst is minimal and that the catalyst stage is not hydrogen mass transfer limited. If the system were hydrogen mass transfer limited, such as would occur if the liquid viscosity were too high or the hydrogen pressure too low, hydrogen would not reach catalyst sites at a sufficient rate to prevent dehydrogenation reactions, whereby excessive coking at catalyst sites would occur and hydrogen consumption would be low.

Table 1 shows the results of tests performed to illustrate the advantageous effect of elevated dissolver temperatures, even without a subsequent catalyst zone. In these tests, a slurry of pulverized Big Horn coal and anthracene oil was passed through a tubular preheater zone in series with a dissolver zone. Some vertical sections of the dissolver zone were packed with inert solids enclosed by porous partitions as shown in U.S. Pat. No. 3,957,619 to Chun et al. No external catalyst was added to the dissolver zone. Heat was added to the preheater zone but the dissolver zone was operated adiabatically. No net heat was added between the preheater and dissolver zones. Elevated dissolver temperatures were achieved by exothermic dissolver hydrocracking reactions.

The Big Horn coal had the following analysis:

| Feed Coal (Moisture Free) | |
|---|---|
| Carbon, Wt. % | 70.86 |
| Hydrogen, Wt. % | 5.26 |
| Nitrogen, Wt. % | 1.26 |
| Oxygen, Wt. % | 19.00 |
| Sulfur, Wt. % | 0.56 |
| Metals, Wt. % | 3.06 |
| Ash, Wt. % | 6.51 |
| Sulfur, Wt. % | 0.32 |
| Oxygen, Wt. % | 3.13 |
| Metals, Wt. % | 3.06 |
| Moisture, Wt. % | 21.00 |

Following are the data obtained in the tests:

TABLE 1

| | | | |
|---|---|---|---|
| Run Time (days) | 3.88 | 5.00 | 11.38 |
| MAF* Coal In Slurry, Wt. % | 29.53 | 29.53 | 29.53 |
| MAF* Coal Rate, gm/hr | 1225.71 | 1101.42 | 1035.20 |
| Preheater Outlet Temp., °F. (°C.) | 713(378) | 715(379) | 729(387) |
| Dissolver Temp., °F. (°C.) | 750(399) | 775(413) | 800(427) |
| Total Pressure, psi (Kg/cm$^2$) | 4100(287) | 4100(287) | 4100(287) |
| $H_2$ pp, psi (Kg/cm$^2$) | 3785(265) | 3842(269) | 3828(268) |
| Unconverted Coal, Wt. % of MAF* Coal | 32.48 | 24.67 | 12.20 |
| Chemical $H_2$ Consumption decimeters$^3$/kg MAF* Coal | 341.96 | 468.42 | 749.10 |
| Conversions, Wt. % MAF* Coal | | | |
| Solvation | 67.52 | 75.36 | 87.80 |
| Hydrocracking (fraction of MAF* coal converted to product boiling below 415° C.) | 17.31 | 31.65 | 54.33 |
| Denitrogenation, Wt. % | 4.78 | 6.31 | 21.32 |
| Oxygen Removal, Wt. % | 42.98 | 47.89 | 51.53 |

*MAF means moisture-and ash-free

The data of Table 1 show that as the dissolver temperature was increased in steps from 750° to 775° and 800° F. (399° to 413° and 427° C.), so that the temperature differential between the preheater and dissolver was increased from 37° F. to 60° F. and 71° F. (20° to 33° and 39° C.), respectively, the amount of coal dissolved increased from 67.52 to 75.36 and 87.80 weight percent of MAF coal, respectively, while the fraction of MAF coal converted to product boiling below 415° C. (779° F.) increased from 17.31 to 31.65 and 54.33 weight percent of MAF coal, respectively. These results illustrate the substantial advantage in terms of both quantity and quality of product obtained by autogenously increasing the temperature differential between the preheater and the dissolver stages by means of exothermic dissolver hydrocracking reactions. Not only is the product quantity and quality advantageously increased as the dissolver temperature and the temperature differential between the stages are increased, but also the process advantageously can become increasingly self-sufficient in heat requirements by transferring the increasingly high level sensible heat autogeneously generated at the dissolver to the preheater. One means of accomplishing this heat transfer is by cooling the dissolver effluent by heat exchange with the preheater feed stream. A noteworthy feature of the tests is that the increasing temperatures were achieved in the dissolver with no net addition of heat to the process between the preheater and dissolver zones.

The process of the present invention which employs a catalyst zone downstream from the dissolver zone is illustrated by the data of Tests 1 through 4, presented in Table 2. Tests 1 through 4 all employed a catalyst zone. Test 1 was performed with only preheater and fixed bed catalyst stages, without any filtering or other solids-removal step between the stages and without any dissolver stage. Tests 2, 3 and 4 were performed with the dissolver stage using a stream comprising 95 percent hydrogen as a quench between the dissolver and fixed bed catalyst stages, but without a solids-removal step in advance of the catalyst stage. In all the tests employing a dissolver, the preheater temperature was below 800° F. (427° C.), specifically 720° to 790° F. (382° to 421° C.), and the solvent used was vacuum tower overhead from previous coal liquefaction runs. In the stage employing a catalyst, the catalyst was a nickel-cobalt-molybdenum on alumina hydrogenation catalyst packed in a plurality of vertical zones having a porous partition communicating with alternate vertical zones free of catalyst.

TABLE 2

| | Test 1 | Test 2 | Test 3 | Test 4 |
|---|---|---|---|---|
| Preheater, °C. (°F.) | — | 382(720) | — | 421(790) |
| Dissolver Temp., °C. (°F.) | No dissolver | 456(853) | 456(853) | 482(900) |
| Reactor (Cat.), °C. (°F.) | 388(730) | 388(730) | 412(775) | 387(729) |
| Reactor WHSV (kg MAFC*/hr/kg Cat.) | | 1.29 | 1.28 | 1.34 |
| Dissolver WHSV (kg A.R.C.**/hr/liter) | | 1.05 | 1.04 | 1.22 |
| Yields, Wt. % MAFC*: | | | | |
| $H_2$ Consumption | −3.12 | −4.9 | −5.9 | −6.1 |
| $C_1$–$C_5$ | 1.13 | 11.8 | 13.9 | 18.8 |
| $C_6$-200° C. | 4.14 | 18.1 | 20.7 | 22.4 |
| 200°–415° C. | | 9.1 | 16.2 | 4.1 |
| 415° C. + (°F.+) | 59.24 | 28.5 | 22.5 | 36.0 |
| Unconverted Coal | 29.73 | 14.5 | 10.8 | 5.7 |
| $H_2S$ | 0.23 | 0.5 | 0.3 | 0.3 |
| CO, $CO_2$ | 2.34 | 10.8 | 12.2 | 5.4 |
| $H_2O$ | 5.95 | 11.6 | 9.3 | 13.4 |
| Solvation | — | 85.5 | 89.2 | 94.3 |
| Conversion (fraction of MAFC* converted to material boiling | | | | |

TABLE 2-continued

| | Test 1 | Test 2 | Test 3 | Test 4 |
|---|---|---|---|---|
| below 415° C. (779° F.) | 11.03 | 57.0 | 66.7 | 58.3 |
| Recycle Solvent (450°-775° F. (232°-412° C.) vacuum tower overhead); % of process requirement | — | — | 96.8 | 92.6 |

*Moisture-and ash-free coal
**As received coal

The data of Test 1 of Table 2 show that without a dissolver stage 29.74 percent of the coal exclusive of moisture and ash remained undissolved and only 11.03 percent was hydrocracked to product boiling below 415° C. (779° F.). Hydrogen consumption was only 3.12 weight percent, based on MAF coal.

The data of Tests 2, 3, and 4 of Table 2 show that the use of a dissolver increased the yields of $C_1$ to $C_5$ products and gasoline, while decreasing the amount of 415° C.+ (799° F.+) oil, and of undissolved coal from 29.74 percent to 14.5 percent, or less. These improved yields were made possible by increased hydrogen consumption. The yield of heavy oil was reduced so drastically that the process did not product its full recycle solvent requirement. Tests 2, 3 and 4 show that as the dissolver temperature increased, the amount of unconverted coal decreased and the amount of hydrogen consumption increased.

The dissolver residence time is sufficient for solids to settle. By separately removing a supernatant liquid stream and a settled solids stream, there can be a controlled build-up of solids in the dissolver, if desired. The coal ash solids contain materials, such as FeS, which are hydrogenation catalysts and provide a beneficial effect in the process. The catalytic effect of coal ash solids in a dissolver zone is disclosed in U.S. Pat. No. 3,884,796 to Hinderliter et al, which is hereby incorporated by reference. Thereby, there can be a controlled catalytic hydrogenation effect in the dissolver zone even though no extraneous catalyst is added to the dissolver zone.

The above-indicated elevated levels of hydrogen consumption in the catalyst zone are possible, because of the advantageous effect of the high temperature dissolver zone upon the catalyst zone. In the absence of the high temperature dissolver zone, the catalyst becomes deactivated so rapidly that such elevated levels of hydrogen consumption can be sustained for only about one week after a fresh catalyst refill, instead of the several months of active catalyst life which is achieved with the high temperature dissolver zone of this invention.

As indicated, a beneficial effect upon catalyst life obtained from the dissolver is due to the formation of an ash-containing sludge at the bottom of the dissolver which can be removed below the supernatant liquid draw-off level. This sludge can comprise as much as about 30 or 50 weight percent ash, or more. However, a large amount of ash particles remains suspended in the supernatant liquid stream flowing from the dissolver to the catalyst zone. These ash particles deposit upon the catalyst and incur a serious catalyst deactivation problem.

In the catalytic hydrotreating of metals-containing residual petroleum oils, which commonly contain about 10 percent or less of asphaltenes, irreversible catalyst deactivation is usually caused by metals deposition on the surface and in the pores of the catalyst. In residual petroleum oil hydrotreating processes, there is an ultimate metals loading on the catalyst at which the catalyst becomes completely deactivated. With certain of such catalysts it was found that upon a gain of 40 percent of their original weight from metals acquired from the feed oil plus a gain about 7 percent of their original weight due to coke deposits, they no longer possess adequate catalytic activity within the temperature constraints of the reactor. Since coke deposits have a lower density than deposited metals, for each one percent of coke on the catalyst above 7 percent the maximum allowable catalyst metals content will be reduced about 2 percent. Conversely, for each one percent of coke deposits that can be eliminated for the catalyst, the catalyst will be able to accept about 2 additional percent of metals before it is completely deactivated.

Coal hydrocarbons are generally richer in asphaltenes than are petroleum hydrocarbons. Asphaltenes are notorious as coke precursors. Therefore, it would be expected that during the catalytic hydrotreatment of coal liquids, the ultimate amount of deposited metals that the catalyst could hold prior to deactivation would be relatively low because of the high coke formation arising from the asphaltenic nature of coal liquids. For example, during the hydrotreatment of a coal liquid with a hydrotreating catalysts at 3,000 psi (210 Kg/cm$^2$) hydrogen pressure, the catalyst was rapidly deactivated primarily due to coke formation, and the metals content on the deactivated catalyst was relatively low. Unexpectedly, however, we have found that at the higher hydrogen pressure of 3,900 psi (273 Kg/cm$^2$), coke formation was found to be so much lower that ultimate deactivation was no longer due to coke deposition.

Whereas the deactivation of a coal liquid hydrotreating catalyst at hydrogen pressures below about 3,100 psi (217 Kg/cm$^2$) was found to be due to coking on the surface of the catalyst, which is only reversible by combustion of the coke, we have found that at hydrogen pressures above 3,100 psi (217 Kg/cm$^2$) or 3,500 psi (245 Kg/cm$^2$) deactivation of the catalyst is due almost entirely to blinding with undissolved coal and ash in the form of inorganic metal salts, rather than to coking. Although this blinding of the catalyst appeared to be a permanent deactivation, we have found it to be reversible not by chemical or oxidative means but rather by mechanical means. To reverse this deactivation, the catalyst is first cleansed and dried in situ by washing with an aromatic liquid, such as anthracene oil or process solvent, followed by drying or purging with a gas, such as hydrogen. The catalyst is then removed from the reactor. While the removed particulate catalyst had the appearance of a continuous carbon-like mass, it was surprisingly found that this mass can be readily crumbled and then sifted on a wire mesh screen, whereupon the inorganic metal salts, such as iron sulfide, pass through the screen. The catalyst particles, now relatively free of these salts, remain on the screen. The catalyst particles remaining on the screen are returned to the reactor for reuse in a subsequent process cycle. The process cycles between these regeneration steps are lengthened by employing the above-described high severity dissolver zone in advance of the catalyst zone, especially when the dissolver zone is provided with means for the separate removal of a portion of the metal salts to prevent these salts from reaching the catalyst zone. Independent removal of a portion of the metal salts can be accomplished by settling and withdrawal of these salts from the bottom of the dissolver zone, or by employing a hydroclone or other physical separation means in advance of the reactor chamber.

We have found that blinding of the catalyst is due to deposition of coal and ash between catalyst particles, inducing interparticle bridging and hindering of reactant flow. The interstitial deposits of coal and ash tend to cement the catalyst particles into a continuous solid mass. Removal of the continuous solid mass from the reactor can be facilitated by disposing the catalyst in the reactor in a plurality of separate baskets, the catalyst content of each being capable of individual removal. According to our discovery, crumbling of a removed solid mass induces disintegration of the interstitial coal and ash, releasing the coal and ash from the catalyst without breaking or disturbing the integrity of the catalyst particles. The disintegrated coal and ash is relatively catalyst-free and has a smaller particle size than the catalyst so that it can be separated therefrom by any suitable means, such as sifting through a screen, while the essentially non-disintegrated catalyst particles remain on the screen for recycling to the process in a relatively ash-free condition. Because the deactivated catalyst mass is crumbled substantially without reducing the size of the catalyst particles and without formation of catalyst fines, the catalyst can be returned to the process intact, thereby avoiding a diffusion problem in the process.

This method is distinguished from the method described in U.S. Pat. No. 3,232,861 to Gorin et al. wherein deactivated catalyst having ash deposited on its exterior surface is subjected to an abrasion operation to remove a mixture of ash and catalyst from the exterior of the catalyst particles, thereby forming ash-free catalyst fines of increased catalyst activity for recycle to the catalyst zone. The present method distinguishes over the Gorin et al, method in two respects. First, the ash which is removed from the catalyst and from the process is substantially free of catalyst, thereby conserving catalyst. Secondly, the catalyst is regenerated without the formation of catalyst fines, thereby avoiding a diffusion problem in the process. These two advantageous effects are achieved because of the discovery that a mild crumbling action disintegrates only the material between the catalyst particles, allowing the catalyst particles to be freed of the interstitial material without themselves experiencing appreciable size reduction or fines formation.

FIG. 1 shows an aging curve illustrating coal liquid hydrotreating catalyst aging tests made at a hydrogen pressure of 3,900 psi (273 Kg/cm$^2$) and a temperature of 730° F. (388° C.). The dashed line represents a run with a reactor filled with catalytically inert solids. The solid lines represent aging runs with a nickel-cobalt-molybdenum on alumina hydrotreating catalyst. In the catalytic tests, after about 46 days the severly deactivated catalyst was regenerated by washing with anthracene oil, flushing with hydrogen and screening. After the catalyst particles were returned to the reactor, it is seen that essentially a full additional process cycle was achieved. It was surprisingly found that a catalyst which was washed, dried and recycled in this manner retained a greater quantity of deposited metals than a similar catalyst which was deactivated in a petroleum oil hydrotreating process, which was not otherwise treated. Although not bound by any theory, it may be that metals deposited on the catalyst in the coal hydrotreating process penetrate more deeply into the catalyst pores, thereby avoiding blockage of the pore openings. It is the blockage of catalyst pore openings which causes early and abrupt termination of catalyst activity in petroleum hydrotreating processes. Therefore, the catalyst screening regeneration method of the present invention permits the process to take advantage of the discovered relatively high metals-holding capacity of a hydrotreating catalyst in a coal liquid hydrotreating process, as compared to a petroleum oil hydrotreating process.

In the aging tests of FIG. 1, the reaction system comprised a preheater which was operated at a maximum temperature of 725° F. (385° C.), followed by the catalyst chamber of the test. No high temperature dissolver chamber was utilized between the preheater and dissolver zones.

The graphs of FIG. 1 are an indication of the amount of hydrogen consumed with processing run times. Hydrogen consumption is a general indicator of catalyst activity in these runs. The hydrogen consumption employing the catalytically inert solids was constant, being unaffected by run time. In the catalytic aging run, the hydrogen consumption declined gradually until about 45 days when it began to decline precipitously and approach that of the inert solids. At this time, the catalyst was washed in situ with anthracene oil to remove coal liquids and then flushed in situ with hydrogen to accomplish drying. The catalyst was then removed from the reactor, manually crumbled and then screened to separate deposited ash and undissolved coal from the catalyst. The screened catalyst was returned to the reactor and a second cycle was started which lasted from about the 48th to the 85th day. The aging data during the second cycle shows that the regenerated catalyst was nearly as active and exhibited nearly as long a cycle life as the same catalyst prior to the regeneration step, demonstrating the effectiveness of the regeneration procedure.

Figure 2:
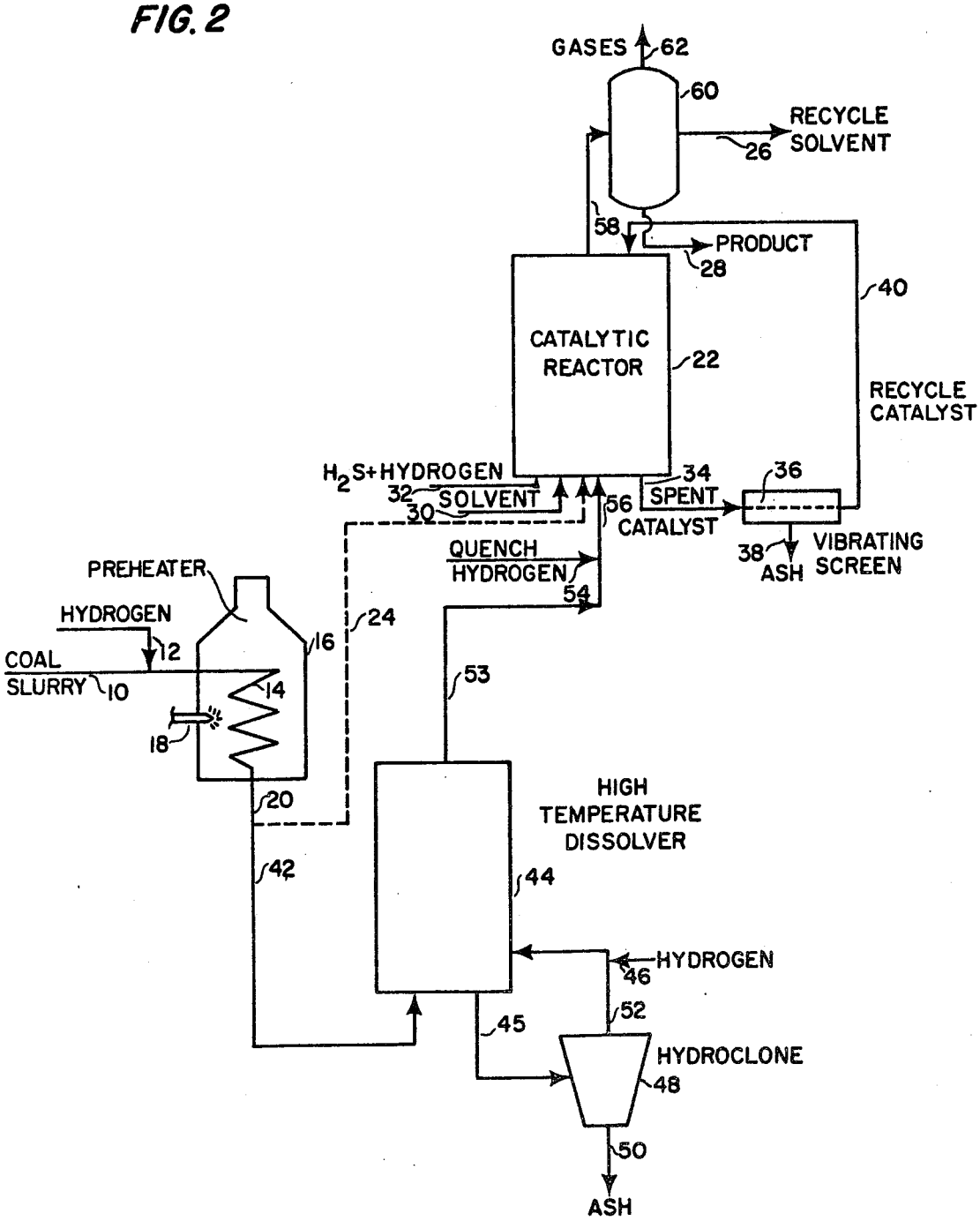

A process scheme for performing the present invention is illustrated in FIG. 2. As shown in FIG. 2, a slurry of pulverized coal and recycle or make-up solvent in line 10 is mixed with hydrogen entering through line 12 and passed through heating coil 14 disposed in furnace 16 which is heated by means of burner 18. The residence time in preheater 16 is 2 to 20 minutes. Effluent from furnace 16 in line 20 is at a temperature between 710° and 800° F. (377° and 427° C.). Reactor 22 contains a hydrogenation catalyst comprising Group VI and Group VIII metals on a non-cracking support. The preheater effluent can be passed directly to reactor 22 by means of dashed line 24, if desired, in which case dissolver 44, hydroclone 48 and quench hydrogen line 54 will be omitted from the process. Reactor 22 is operated at a temperature in the range of about 700° to about 825° F. (371° to 441° C.). The process operates at a hydrogen pressure above 3,100 psi (217 Kg/cm$^2$). Reactor effluent liquid in line 58 is fractionated in column 60 to obtain hydrogen-containing gases passing through line 62, recycle solvent passing through line 26 and liquid product which is discharged through line 28.

As the catalytic reactor 22 becomes deactivated, the reactor temperature can be gradually increased from a SOR temperature of about 700° F. (371° C.) to an EOR temperature of about 825° F. (441° C.). When a reactor temperature of about 825° F. (441° C.) is reached, the cycle is terminated and a solvent, such as process solvent or an aromatic liquid such as anthracene oil, entering through line 30 is passed over the catalyst to remove coal liquids from the catalyst. Thereupon, the catalyst is dried by flushing it was a gas, such as hydrogen or hydrogen sulfide plus hydrogen, entering through line 32. Hydrogen sulfide is useful to maintain the catalyst in an active sulfided state for the next process cycle. Catalyst containing caked ash is then removed from the reactor through line 34, crumbled and agitated on a vibrating screen 36 until its dry, caked ash content passes through the screen, while the catalyst particles, which can be about ⅛ inch in diameter, remain on the screen. The ash is removed from the process through line 38 while the screened catalyst is recycled to the reactor through line 40 for the start of another cycle.

FIG. 2 also show an embodiment adapted to remove a significant portion of the ash in advance of catalyst chamber 22 in order to obtain a longer cycle from the catalyst between screening operations. In this embodiment, dashed line 24 is omitted. Instead, preheater effluent at a temperature between about 710° and 800° F. (377° and 427° C.) is passed from line 20 through line 42 to a high temperature dissolver 44 which is maintained at a temperature between about 750° and 900° F. (399° and 482° C.). The temperature in dissolver 44 can be controlled by the injection of hot or cool hydrogen through line 46. A sediment containing as much as about 50 percent ash settles in the dissolver and can be removed through line 45 for passage to hydroclone 48 from which ash is removed through line 50 while liquid is removed through line 52 for recycle to the dissolver.

The dissolver effluent stream in line 53 is quenched with hydrogen entering through line 54, or is otherwise cooled, and the resulting stream in line 56 at a temperature between about 700° and 800° F. (371° and 427° C.) is charged to reactor chamber 22. Because of the removal of a considerable portion of the inorganic solids through line 50, the cycle life of the catalyst in reactor 22 will be lengthened. When the temperature in reactor 22 reaches about 825° F. (441° C.), regeneration of the reactor will proceed employing solvent washing, gas drying and screening of the catalyst, as described above.

We claim:

1. A process for liquefying coal comprising passing an ash-containing coal-solvent slurry and hydrogen through a heating zone and a catalytic hydrogenation zone, said hydrogenation zone containing particles of hydrogenation catalyst comprising Group VI and Group VIII metals, said particles of catalyst being cemented with coal and ash to form a continuous solid mass during said process, terminating said process upon reduction in catalytic hydrogenation activity, removing said catalyst as a continuous ash and coal-containing solid mass from said hydrogenation zone, crumbling said continuous solid mass into a crumbled mass comprising relatively small and relatively catalyst-free ash and coal-containing particulate impurities, said catalyst free ash particulate impurities being small compared to the size of said particles of catalyst said crumbling step occuring substantially without size reduction of said catalyst particles, separating said relatively small ash and coal-containing particulate impurities from said catalyst particles and returning said catalyst particles substantially without size reduction to said process.

2. The process of claim 1 wherein the hydrogen pressure in the catalytic hydrogenation zone is above about 3,100 psi.

3. The process of claim 1 wherein the hydrogen pressure in the catalytic hydrogenation zone is above about 3,500 psi.

4. The process of claim 1 wherein the temperature in the catalytic hydrogenation zone is in the range 700° to 825° F.

5. The process of claim 1 wherein said catalyst is cleansed and dried prior to removal from said hydrogenation zone.

6. The process of claim 5 wherein said catalyst is cleansed by flushing with an aromatic oil.

7. The process of claim 5 wherein said catalyst is dried in situ by means of a purge gas.

8. The process of claim 6 wherein said aromatic oil is process solvent.

9. The process of claim 7 wherein said pruge gas is hydrogen.

10. The process of claim 1 wherein said relatively small ash and coal-containing particulate impurities are separated from catalyst particles by sifting said crumbled mass through a screen.

11. The process of claim 1 wherein the catalyst in said hydrogenation zone is disposed in a plurality of separate baskets.

12. The process of claim 1 including a dissolver zone between said heating zone and said catalytic hydrogenation zone.

13. The process of claim 1 wherein the ash-containing coal-solvent slurry and hydrogen are passed through a heating zone and a dissolver zone in advance of said catalytic hydrogenation zone.

* * * * *